US008544896B2

(12) United States Patent
Liu

(10) Patent No.: US 8,544,896 B2
(45) Date of Patent: Oct. 1, 2013

(54) STOP DEVICE FOR PREVENTING OPENING OF DEFORMED DOOR

(76) Inventor: Ming-I Liu, Tainan (TW)

( * ) Notice: Subject to any disclaimer, the term of this patent is extended or adjusted under 35 U.S.C. 154(b) by 436 days.

(21) Appl. No.: 13/023,620

(22) Filed: Feb. 9, 2011

(65) Prior Publication Data

US 2012/0200094 A1 Aug. 9, 2012

(51) Int. Cl.
*E05B 65/10* (2006.01)

(52) U.S. Cl.
USPC ..... 292/92; 292/21; 292/DIG. 65

(58) Field of Classification Search
USPC ..... 292/92, 21, DIG. 65
See application file for complete search history.

(56) References Cited

U.S. PATENT DOCUMENTS 3,776,582 A * 12/1973 Balducci ..... 292/92
3,788,687 A * 1/1974 Zawadzki ..... 292/92
3,877,262 A * 4/1975 Williams ..... 70/92
4,545,606 A * 10/1985 Vodra ..... 292/92
5,035,450 A * 7/1991 Muller ..... 292/92
5,762,385 A * 6/1998 Mader et al. ..... 292/219
5,904,384 A * 5/1999 Mader et al. ..... 292/333
6,009,732 A * 1/2000 Haeck et al. ..... 70/92
7,832,777 B2 * 11/2010 Banks et al. ..... 292/92
2007/0246946 A1 * 10/2007 Arlinghaus et al. ..... 292/93
2012/0256428 A1 * 10/2012 Tien ..... 292/92

* cited by examiner

*Primary Examiner* — Carlos Lugo
*Assistant Examiner* — Mark Williams
(74) *Attorney, Agent, or Firm* — Alan Kamrath; Kamrath IP Lawfirm, P.A.

(57) ABSTRACT

A stop device (60) includes a stop (61) mounted to an inner face (11A) of a door frame (11). The stop (61) includes a wing (78) having a catch (86) with a stop face (88). A limiting member (92) is mounted to the wing (78) and releasably engaged with a latch (38) of a panic exit door lock (2) mounted to a door (1) that is pivotably mounted to the door frame (11). An engaging member (108) is fixed to the door (1) and includes a tongue (116). The tongue (116) is located between the inner face (11A) of the door frame (11) and the catch (86) when the door (1) is in a closed position. When the door (1) deforms and moves away from the inner face (11A) of the door frame (11), the tongue (116) abuts the stop face (88) of the catch (86), preventing the latch (38) from disengaging from the limiting member (92) to prevent opening of the deformed door (1).

8 Claims, 6 Drawing Sheets

STOP DEVICE FOR PREVENTING OPENING OF DEFORMED DOOR

BACKGROUND OF THE INVENTION

The present invention relates to a stop device and, more particularly, to a stop device for preventing opening of a deformed door, particularly a panic exit door that deforms due to the heat of a fire.

A type of lock for a panic exit door or fireproof door available on the market is substantially T-shaped and mounted and exposed to a side of the panic exit door. The panic exit door lock generally includes a latch pivotable between an extended, latching position and a retracted, unlatching position. An end of the door is pivotably mounted to a door frame, allowing opening or closing of the door. The panic exit door lock is mounted to the other end of the door. When the door is closed, the other end of the door abuts the door frame and seals the passageway defined by the door frame. A stop is mounted to an inner face of the door frame facing the latch. The stop includes a limiting member. When the door is moving from the open position to the closed position, the latch is pressed by the stop and pivots to the retracted, unlatching position, so that the latch can pass through the limiting member. When the door reaches the closed position, the latch is misaligned with the limiting member, so that the latch pivots back to the extended, latching position. In this case, the door can not be opened, because the latch in the extended, latching position is stopped by the limiting member, maintaining the door in the closed position. The panic exit door lock is generally mounted to a panic exit door accessible to stairs in a building. The panic exit door is generally made of heat resistant material. By using such a panic exit door lock, the panic exit door can be maintained in the closed position when a fire occurs, blocking the fire and smoke. However, the panic exit door may still deform due to high heat of a great fire. The relative position between the latch and the stop may change due the deformation of the panic exit door, leading to the risk of opening of the panic exit door by the pressure resulting from the high heat.

Thus, a need exists for a stop device for reliably preventing opening of a deformed panic exit door.

BRIEF SUMMARY OF THE INVENTION

The present invention solves this need and other problems in the field of reliable closing of a deformed door during a fire by providing, in a preferred form, a stop device including a stop having a base with first and second surfaces spaced along a first axis. The base further includes first and second lateral surfaces spaced along a second axis perpendicular to the first axis. The base further includes a first wing extending away from the first surface of the base along the first axis. The first wing includes a lateral face spaced from the second lateral surface of the base along the second axis. The first wing further includes upper and lower faces spaced along a third axis perpendicular to the first and second axes. The first wing further includes a catch extending from the upper face to the lower face of the first wing. The catch includes a stop face connected to the lateral face of the first wing. The stop is adapted to be mounted to an inner face of a door frame with the second surface of the base facing the inner face of the door frame. A limiting member is mounted to the first wing. The limiting member is adapted to be releasably engaged with a latch of a panic exit door lock mounted to a door that is pivotably mounted to the door frame. The latch is stopped by the limiting member when the door is closed and abuts the door frame and when the latch is in an extended, latching position. The door is openable when the latch is in a retracted, unlatching position. An engaging member includes first and second lateral faces spaced along the second axis. The engaging member further includes a tongue extending away from the first lateral face of the engaging member along the second axis. The tongue further includes first and second faces spaced along the first axis. The engaging member is adapted to be fixed to the door. The tongue is located between the inner face of the door frame and the catch when the door is in a closed position with the first face spaced from the stop face of the catch along the first axis.

When the door deforms and moves away from the inner face of the door frame along the first axis, the first face of the tongue abuts the stop face of the catch of the stop, preventing the latch from disengaging from the limiting member to prevent opening of the deformed door.

Preferably, the stop further includes a second wing extending away from the first surface of the base along the first axis and spaced from the first wing along the third axis. The limiting member is mounted between the first and second wings.

Preferably, the first and second wings define a space therebetween. The first and second wings include upper and lower pegs aligned with each other along the third axis and located in the space. The limiting member is a hollow cylinder rotatably received between the first and second pegs. A pin extends through the upper and lower pegs and the limiting member.

Preferably, the base further includes an opening extending from the first surface through the second surface along the first axis. The opening extends from the first lateral surface towards but spaced from the second lateral surface along the second axis. The opening is located intermediate the first and second wings along the third axis.

Preferably, the second wing includes upper and lower faces spaced along the third axis. The catch of an upper one of the first and second wings extends from the upper face of the upper wing to a lower end face of the upper peg. The catch of a lower one of the first and second wings extends from the lower face of the lower wing to an upper end face of the lower peg.

Preferably, a gasket is mounted between the base of the stop and the inner face of the door frame. The gasket includes a first slot extending along the second axis. The base includes a second slot extending along the second axis and aligned with the first slot. A screw extends through the first and second slots into the inner face of the door frame while allowing adjustment of a position of the stop relative to the inner face of the door frame along the second axis. The second surface of the base includes a plurality of positioning grooves. The gasket includes a protrusion releasably engaged in one of the plurality of positioning grooves.

Preferably, the first face of the tongue further includes a plurality of substantially V-shaped engaging grooves each having an inclined abutment face. The stop face of the catch of the stop abuts the abutment face of one of the plurality of engaging grooves when the door deforms along the first or second axis, preventing the latch from disengaging from the limiting member along the first or second axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
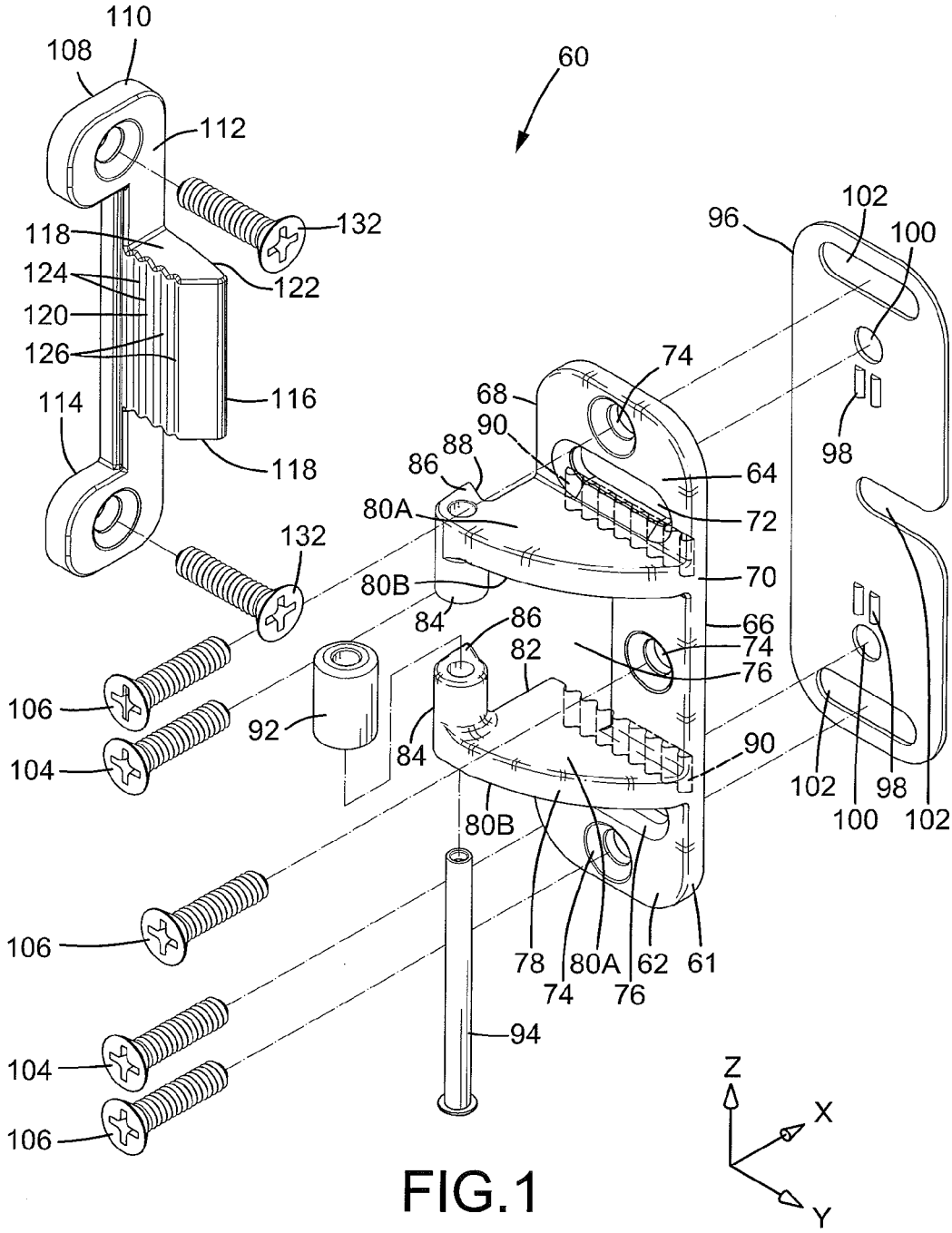
FIG. 1 shows an exploded, perspective view of a stopping device according to the preferred teachings of the present invention.
Figure 2:
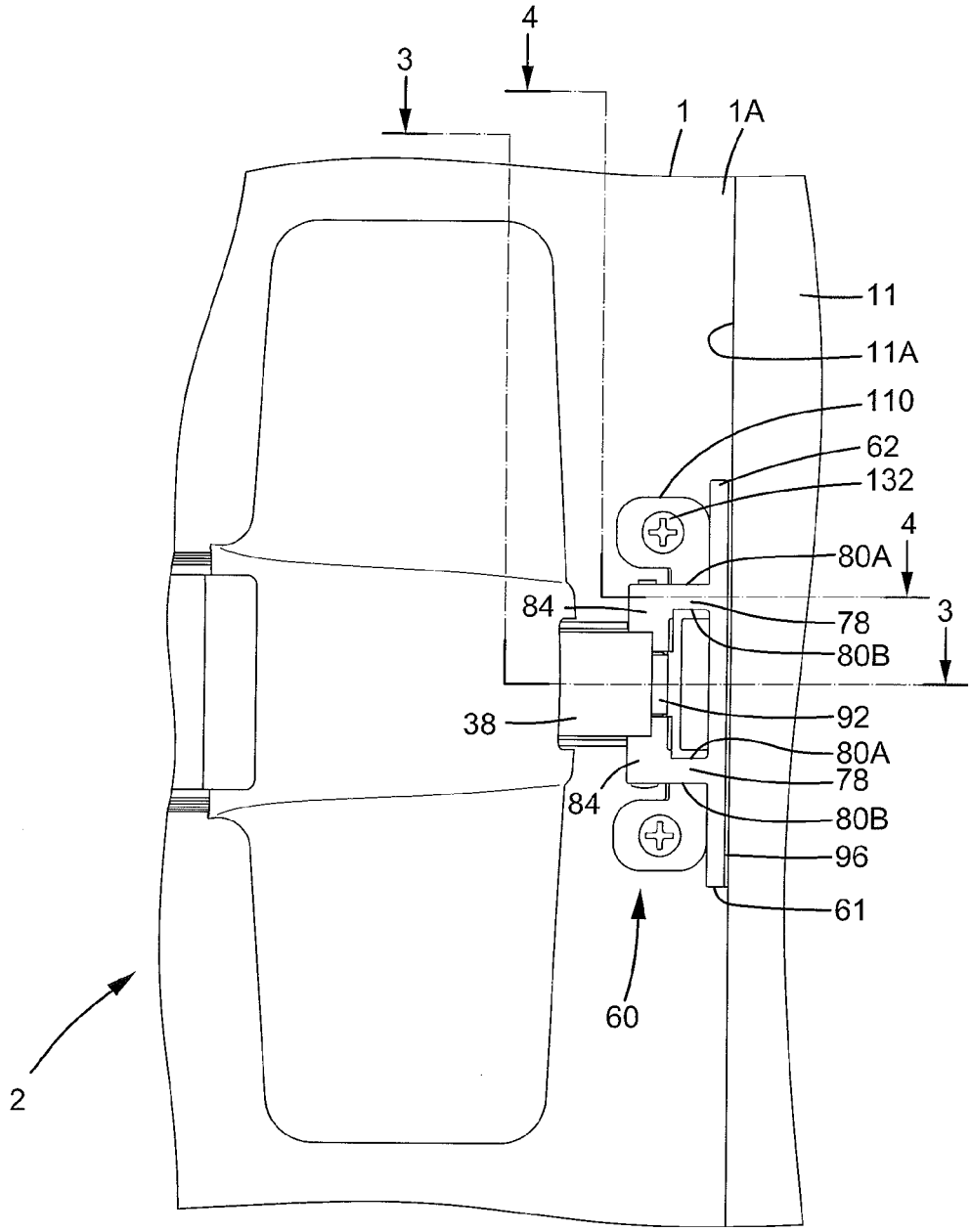
FIG. 2 shows a partial, elevational view of a door to which the stopping device according to the present invention is mounted, illustrating adjustment of a stop during installation of the stopping device.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "inner", "outer", "side", "end", "portion", "lateral", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 3:
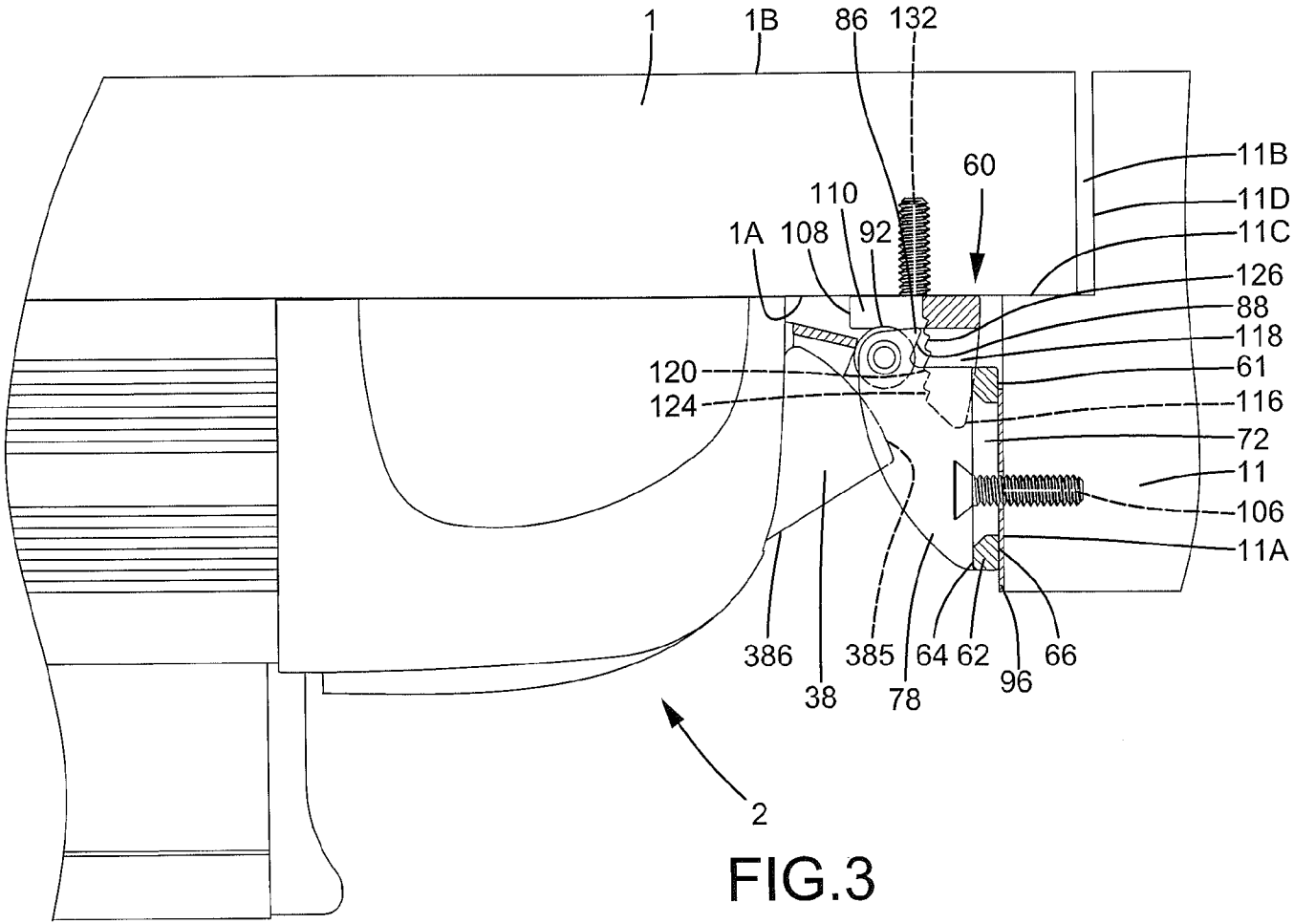
FIG. 3 shows a cross sectional view taken along section line 3-3 of FIG. 2.
Figure 4:
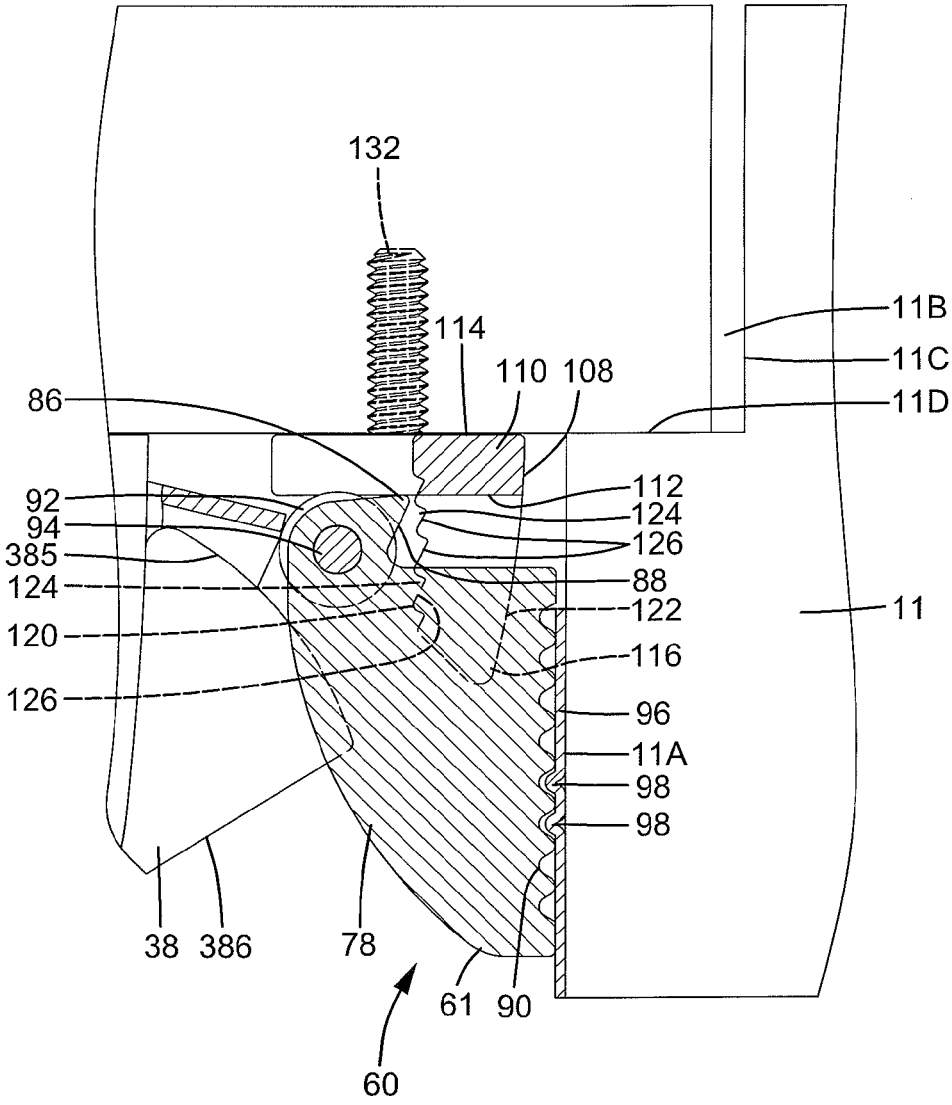
FIG. 4 shows a cross sectional view taken along section line 4-4 of FIG. 2.

A stop device according to the preferred teachings of the present invention is shown in the drawings and generally designated 60. According to the preferred form shown, stop device 60 includes a stop 61 mounted to a door frame 11 having rectangular or U-shaped cross sections. Stop device 60 further includes an engaging member 108 mounted to a door 1. Door frame 11 is fixed in a wall and defines a passageway. Door frame 11 includes an inner face 11A and a stepped portion 11B extending between inner face 11A and an outer side of door frame 11A. Stepped portion 11B includes an abutting face 11C extending perpendicularly from inner face 11A and a face 11D extending perpendicularly to abutting face 11C and parallel to and spaced from inner face 11A. Door 1 includes first and second sides lA and 1B. An end of door 1 is pivotably connected to door frame 11, allowing opening and closing of door 1 by pivoting door 1 relative to door frame 11. When door 1 is closed, first side lA of door 1 abuts abutting face 11C (FIG. 3) and is spaced from face 11D of stepped portion 11B.

According to the preferred form shown, a panic exit door lock 2 is mounted to first side 1A of door 1. Panic exit door lock 2 includes a latch 38 pivotable between a retracted, unlatching position (see phantom lines in FIG. 5) and an extended, latching position (see)

FIGS. 2-6). Latch 38 includes a stop face 385 and a push face 386. When push face 386 is subjected to force, latch 38 pivots to the retracted, unlatching position. When stop face 385 is subjected to force, latch 38 is maintained in the extended, latching position. When door 1 is closed, latch 38 faces and is spaced from inner face 11A of door frame 11.

According to the preferred form shown, stop 61 includes a base 62 having first and second surfaces 64 and 66 spaced along a first axis X. Base 62 further includes first and second lateral surfaces 68 and 70 spaced along a second axis Y perpendicular to first axis X and extending between first and second surfaces 64 and 66. Base 62 further includes upper and lower wings 78 extending away from first surface 64 along first axis X. Upper and lower wings 78 have sector-shaped cross sections and are spaced along a third axis Z perpendicular to first and second wings 78. Each of upper and lower wings 78 includes upper and lower faces 80A and 80B spaced along third axis Z. Each of first and second wings 78 further includes a lateral face 82 spaced from second lateral surface 70 along second axis Y and connected to first lateral surface 68. An upper peg 84 extends downward from lower surface 80B of upper wing 78 along third axis Z. A lower peg 84 extends upward from upper face 80A of lower wing 78 along third axis Z. Upper and lower pegs 84 are spaced along third axis Z. A substantially V-shaped upper catch 86 extends from upper face 80A of upper wing 78 to a lower end face of upper peg 84. A substantially V-shaped lower catch 86 extends from lower face 80B of lower wing 78 to an upper end face of lower peg 84. Upper catch 86 includes a stop face 88 connected to lateral face 82 of upper wing 78. Lower catch 86 includes a stop face 88 connected to lateral face 82 of lower wing 78.

According to the preferred form shown, base 62 includes upper and lower slots 72 each extending from first surface 64 through second surface 66 along first axis X. Upper and lower slots 72 are spaced along third axis Z. Upper and lower wings 78 are located intermediate upper and lower slots 72. Base 62 further includes upper, middle, and lower through-holes 74 extending from first surface 64 through second surface 66 along first axis X. Upper through-hole 74 is located above upper wing 78 and above slot 72 in the most preferred form shown. Middle through-hole 74 is located between upper and lower wings 78. Lower through-hole 74 is located below lower wing 78 and below lower slot 72 in the most preferred form shown. Base 62 further includes an opening 76 extending from first surface 64 through second surface 66 along first axis X. Opening 76 extends from first lateral surface 68 towards but spaced from second lateral surface 70 along second axis Y. Opening 76 is located intermediate upper and lower wings 78 along third axis Z. Second surface 66 of base 62 further includes a plurality of upper positioning grooves 90 formed by a plurality of teeth or other provisions and a plurality of lower positioning grooves 90 formed by a plurality of teeth or other provisions. Upper and lower positioning grooves 90 are aligned with upper and lower wings 78 along third axis Z.

According to the preferred form shown, stop device 60 further includes a limiting member 92 in the form of a hollow cylinder. Limiting member 92 is rotatably mounted between upper and lower pegs 84 with a pin 94 extending through upper and lower pegs 84 and limiting member 92. Thus, limiting member 92 is pivotably received between upper and lower pegs 84.

Figure 5:
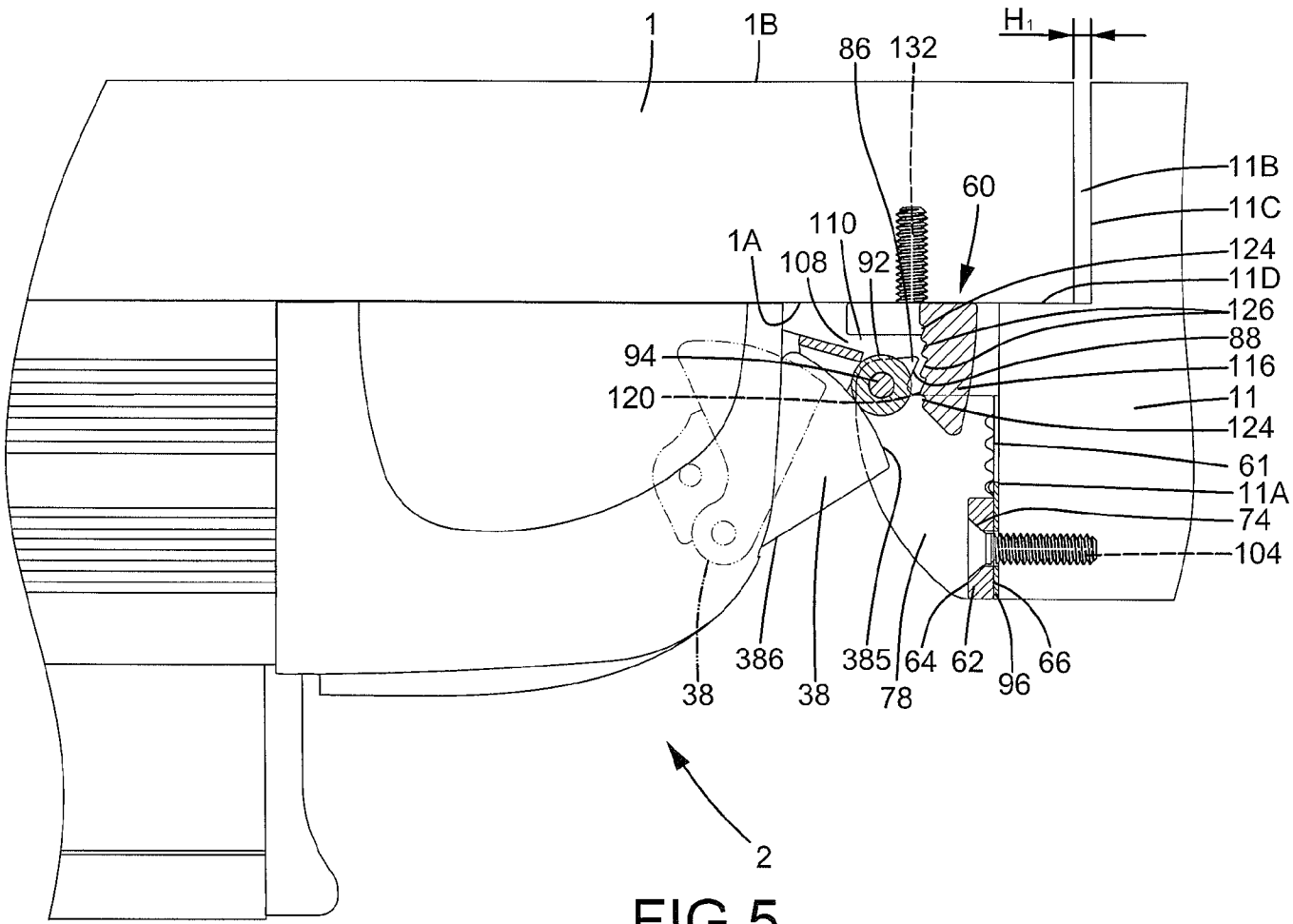
FIG. 5 shows a view similar to FIG. 3, with installation of the stopping device completed.

According to the preferred form shown, stop device 60 further includes a gasket 96 having a side with two upper protrusions 98 and two lower protrusions 98. Gasket 96 further includes two through-holes 100 and three slots 102. Gasket 96 is mounted to inner face 11A of door frame 11. Stop 61 is mounted to gasket 96 with second surface 66 abutting the side of gasket 96. Upper protrusions 98 are engaged in two of upper positioning grooves 90, and lower protrusions 98 are engaged in two of lower positioning grooves 90. The position of stop 61 relative to gasket 96 along second axis Y can be adjusted by engaging upper and lower protrusions 98 in desired upper and lower positioning grooves 90 through movement of stop 61 relative to gasket 96 along second axis Y, so that limiting member 92 can be moved to a desired location relative to latch 38. Screws 104 are extended through upper and lower slots 72 of stop 61 and through-holes 100 into door frame 11. The position of stop 61 relative to gasket 96 can be adjusted before tightening screws 104. Screws 104 can be tightened when limiting member 92 abuts latch 38 (FIG. 5). Thus, stop 61 can be fixed to inner face 11A of door frame 11 at a desired location. Screws 106 are then extended through upper, middle, and lower through-holes 74 of stop 61 and slots 102 of gasket 96 into door frame 11, reliably fixing stop 61 to door frame 11.

According to the preferred form shown, engaging member 108 of stop device 60 includes a bottom plate 110 having first and second lateral faces 112 and 114 spaced along second axis Y. Engaging member 108 further includes a tongue 116 extending away from first lateral face 112 along second axis Y. A length of tongue 116 along third axis Z is slightly smaller than a spacing between upper and lower wings 78. Tongue 116 includes top and bottom faces 118 spaced along third axis Z. Each of top and bottom faces 118 is connected to first lateral face 112. Tongue 116 further includes first and second faces 120 and 122 extending between top and bottom faces 118 and spaced along first axis X. First face 120 of tongue 116 further includes a plurality of engaging grooves 124 in the form of substantially V-shaped continuous teeth or the like. Each engaging groove 124 has an inclined abutment face 126. Engaging member 108 is fixed by extending two screws 132 to first side IA of door 1. Engaging member 108 is spaced from latch 38 along first axis X.

Now that the basic construction of stop device 60 of the preferred teachings of the present invention has been explained, the operation and some of the advantages of stop device 60 can be set forth and appreciated. In particular, for the sake of explanation, it will be assumed that door 1 is in a closed position in which first side 1A of door 1 abuts abutting face 11C of stepped portion 11B. Stop face 385 of latch 38 abuts limiting member 92 (FIG. 5). Tongue 116 is located between inner face 11A of door frame 11 and catch 86. A portion of tongue 116 extends into a space between upper and lower wings 78. First face 120 of engaging member 108 faces and is spaced from stop face 88 of catch 86 of stop 61. Second face 122 of engaging member 108 faces first surface 64 of stop 61. Engaging grooves 124 of engaging member 108 are spaced from catch 86 of stop 61 along first axis X by a small spacing of about 1 mm. In this case, when it is intended to open door 1, stop face 385 of latch 38 presses against limiting member 92, so that door 1 is stopped by latch 38 and limiting member 92, preventing opening of door 1. However, panic exit door lock 2 can be operated to move latch 38 to the retracted, unlatching position (see phantom lines in FIG. 5), so that latch 38 disengages from limiting member 92, allowing opening of door 1 without being stopped by latch 38 and limiting member 92. It can be appreciated that opening 76 of stop 61 provides room for movement of engaging member 108 while door 1 is pivoted. With reference to FIG. 5, when door 1 does not deform, a gap HI exits between an end face of door 1 and face 11D of stepped portion 11B, allowing normal opening and closing of door 1.

Figure 6:
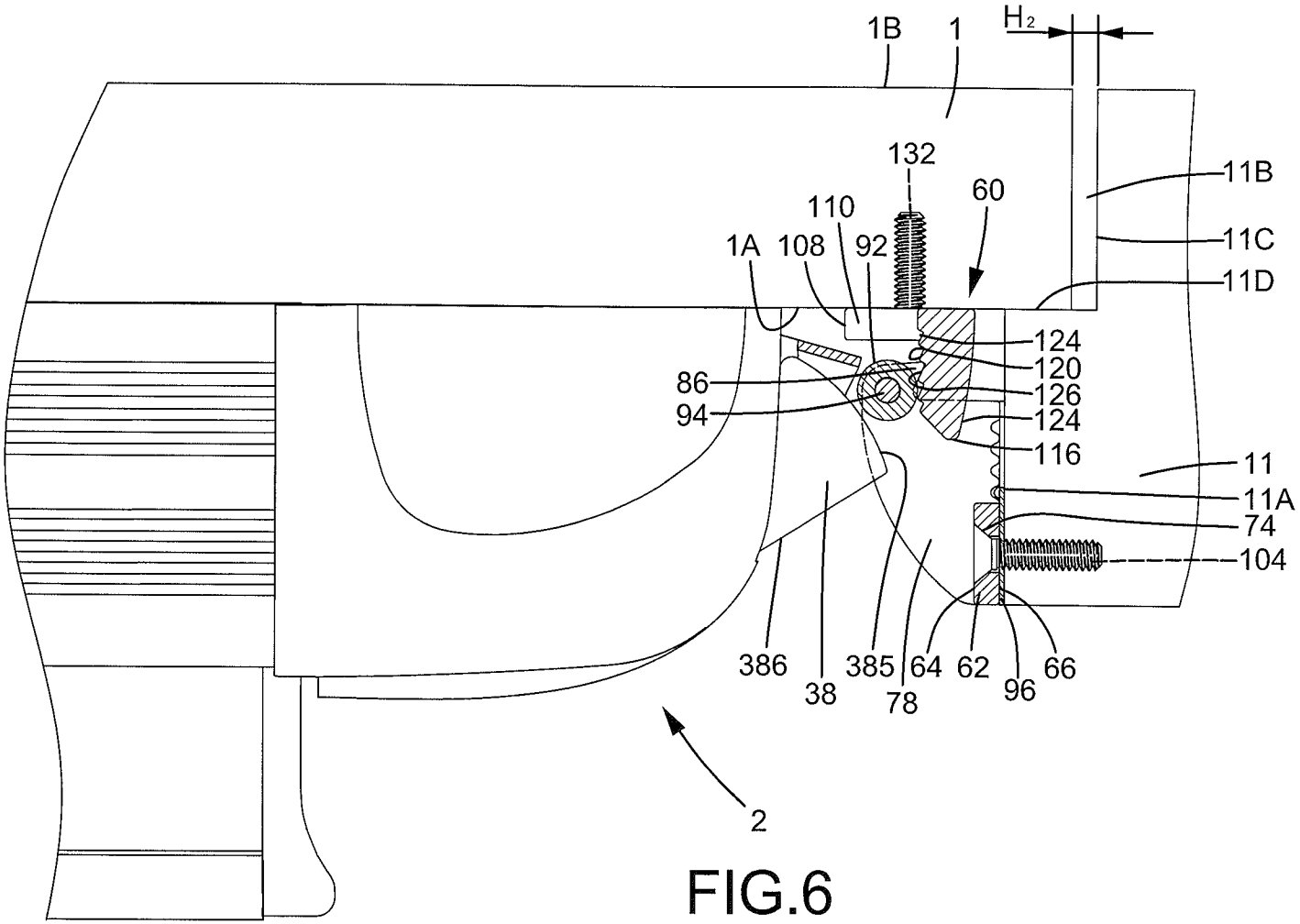
FIG. 6 shows a view similar to FIG. 5, illustrating movement of a latch while the door deforms due to heat.

With reference to FIG. 6, in a case that door 1 deforms along first axis X due to an increase in the environmental temperature resulting from a fire, the gap between the end face of door 1 and face 11D of stepped portion 11B is increased (see gap H2), so that latch 38 moves away from limiting member 92 along first axis X. Engaging member 108 also moves along first axis X due to deformation of door 1, so that abutment face 126 of one of engaging grooves 124 of engaging member 108 abuts against stop face 88 of catch 86 of stop 61. Thus, door 1 will be dragged and retained in place by engagement between engaging member 108 and stop 61. As a result, latch 38 will only be moved away from limiting member 92 to a small extent even if door 1 continues to deform. This avoids door 1 from being opened in an unexpected manner.

Stop device 60 according to the preferred teachings of the present invention can prevent opening of door 1 in a fire by preventing catch 86 from disengaging from limiting member 92. Spread of the fire and smoke is avoided. Furthermore, engaging grooves 124 in the form of continuous teeth allow easy adjustment of stop 61 along second axis Y. Namely, stop 61 can be moved to a position abutting stop face 385 of latch 38. After adjustment, the position of catch 86 of stop 61 can be aligned with abutment face 126 of one of engaging grooves 124, allowing easy installation of stop device 60 according to the preferred teachings of the present invention. Furthermore, abutment face 126 of engaging member 108 is inclined, so that engaging member 108 prevents disengagement of latch 38 from limiting member 92 along first and second axes X and Y when door I deforms.

Now that the basic teachings of the present invention have been explained, many extensions and variations will be obvious to one having ordinary skill in the art. For example, stop 61 can include only one wing 78 and only one peg 84. In this case, pin 94 can have a shorter length along third axis Z. Furthermore, stop device 60 does not have to include upper and lower pegs 84, and limiting member 92 can be directly mounted between upper and lower wings 78. In this case, upper catch 86 extends from upper face 80A to lower face 80B of upper wing 78, and lower catch 86 extends from upper face 80A to lower face 80B of lower wing 78. Further, stop device 60 does not have to include gasket 96, and stop 61 is directly fixed to inner face 11A of door frame 11. Further, engaging member 108 does not have to include engaging grooves 124. In this case, first face 120 of engaging member 108 can still abut against catch 86 of stop 61 when door 1 deforms, preventing latch 38 from completely disengaging from limiting member 92. Further, the number and position of slots 72 and 102 can be varied according to needs. Further, stop 61 does not have to include either or both of upper and lower positioning grooves 90, and gasket 96 does not have to include either or both of upper and lower protrusions 98. In this case, elongated slots 72 and 102 allow adjustment of the position of stop 61.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A stop device comprising, in combination:

a stop including a base having first and second surfaces spaced along a first axis, with the base further including first and second lateral surfaces spaced along a second axis perpendicular to the first axis, with the base further including a first wing extending away from the first surface of the base along the first axis, with the first wing including a lateral face spaced from the second lateral surface of the base along the second axis, with the first wing further including upper and lower faces spaced along a third axis perpendicular to the first and second axes, with the first wing further including a catch extending from the upper face to the lower face of the first wing, with the catch including a stop face connected to the lateral face of the first wing, with the stop adapted to be mounted to an inner face of a door frame with the second surface of the base facing the inner face of the door frame;

a limiting member mounted to the first wing, with the limiting member adapted to be releasably engaged with a latch of a panic exit door lock mounted to a door that is pivotably mounted to the door frame, with the latch stopped by the limiting member when the door is closed and abuts the door frame and when the latch is in an extended, latching position, with the door being openable when the latch is in a retracted, unlatching position;

an engaging member including first and second lateral faces spaced along the second axis, with the engaging member further including a tongue extending away from the first lateral face of the engaging member along the second axis, with the tongue further including first and second faces spaced along the first axis, with the engaging member adapted to be fixed to the door, with the tongue located between the inner face of the door frame and the catch when the door is in a closed position with the first face spaced from the stop face of the catch along the first axis, wherein when the door deforms and moves away from the inner face of the door frame along the first axis, the first face of the tongue abuts the stop face of the catch of the stop, preventing the latch from disengaging from the limiting member to prevent opening of the deformed door.

2. The stop device as claimed in claim 1, with the first face of the tongue further including a substantially V-shaped engaging groove having an inclined abutment face, with the stop face of the catch of the stop abutting the abutment face of the engaging groove when the door deforms along the first or second axis, preventing the latch from disengaging from the limiting member along the first or second axis.

3. The stop device as claimed in claim 1, with the stop further including a second wing extending away from the first surface of the base along the first axis and spaced from the first wing along the third axis, with the limiting member mounted between the first and second wings .

4. The stop device as claimed in claim 3, with the first and second wings defining a space therebetween, with the first and second wings including upper and lower pegs aligned with each other along the third axis and located in the space, with the limiting member being a hollow cylinder rotatably received between the first and second pegs, with a pin extending through the upper and lower pegs and the limiting member.

5. The stop device as claimed in claim 4, with the base further including an opening extending from the first surface through the second surface along the first axis, with the opening extending from the first lateral surface towards but spaced from the second lateral surface along the second axis, with the opening located intermediate the first and second wings along the third axis.

6. The stop device as claimed in claim 5, with the second wing including upper and lower faces spaced along the third axis, with the catch of one of the first and second wings extending from the upper face of the upper wing to a lower end face of the upper peg, with the catch of another of the first and second wings extending from the lower face of the lower wing to an upper end face of the lower peg.

7. The stop device as claimed in claim 6, further comprising, in combination: a gasket mounted between the base of the stop and the inner face of the door frame, with the gasket including a first slot extending along the second axis, with the base including a second slot extending along the second axis and aligned with the first slot, with a screw extending through the first and second slots into the inner face of the door frame while allowing adjustment of a position of the stop relative to the inner face of the door frame along the second axis, with the gasket including a protrusion, with the second surface of the base including a plurality of positioning grooves, with the protrusion releasably engaged in one of the plurality of positioning grooves.

8. The stop device as claimed in claim 7, with the first face of the tongue further including a plurality of substantially V-shaped engaging grooves each having an inclined abutment face, with the stop face of the catch of the stop abutting the abutment face of one of the plurality of engaging grooves when the door deforms along the first or second axis , preventing the latch from disengaging from the limiting member along the first or second axis.

* * * * *